US008272425B2

(12) United States Patent
Coenraets

(10) Patent No.: US 8,272,425 B2
(45) Date of Patent: Sep. 25, 2012

(54) DEVICE WITH A SHUTTER WHICH MAY BE WOUND AROUND A DRUM

(75) Inventor: Benoit Coenraets, Brussels (BE)

(73) Assignee: Dynaco Europe, Moorsel (BE)

( * ) Notice: Subject to any disclaimer, the term of this patent is extended or adjusted under 35 U.S.C. 154(b) by 113 days.

(21) Appl. No.: 12/525,787

(22) PCT Filed: Feb. 4, 2008

(86) PCT No.: PCT/EP2008/051344
§ 371 (c)(1),
(2), (4) Date: Aug. 4, 2009

(87) PCT Pub. No.: WO2008/101796
PCT Pub. Date: Aug. 28, 2008

(65) Prior Publication Data

US 2010/0101739 A1 Apr. 29, 2010

(30) Foreign Application Priority Data

Feb. 7, 2007 (EP) ..... 07101917

(51) Int. Cl.
*E06B 9/56* (2006.01)

(52) U.S. Cl. ..... 160/273.1; 160/270; 160/272; 160/271; 160/133

(58) Field of Classification Search ..... 160/273.1, 160/270, 272, 271, 133; 16/96 R, 187, 198
See application file for complete search history.

(56) References Cited

U.S. PATENT DOCUMENTS 1,791,548 A * 2/1931 Zucca ..... 160/267.1
1,892,570 A * 12/1932 Ginder ..... 160/88
2,247,306 A * 6/1941 Partridge ..... 160/41
2,271,099 A * 1/1942 Schur ..... 160/241
2,564,197 A * 8/1951 Dobkin ..... 160/133
(Continued)

FOREIGN PATENT DOCUMENTS

CA 2426217 10/2004
(Continued)

OTHER PUBLICATIONS

Search Report for Application No. PCT/EP2008/051344, 4 pages.

*Primary Examiner* — Katherine W Mitchell
*Assistant Examiner* — Marcus Menezes
(74) *Attorney, Agent, or Firm* — Reichel IP LLP; Kevin R. Erdman; Mark C. Reichel

(57) ABSTRACT

The invention relates to a flexible shutter device, designed for closing a bay or other opening which cooperates with drive means which permit a displacement of the flexible shutter between an open position and a closed position. The device comprises a drum which may turn about the axis thereof and about which the flexible shutter is wound in the open position thereof, forming a roll comprising turns made up of successive layers attaching one to the other and from which the flexible shutter can be unwound and pushed into the closed position thereof. Slides mounted on a fixed support provide guidance along the bay for the unwound part of the flexible shutter. Pressure or restriction elements (33, 50, 66) avoid buckling of the lateral edges (2,3) in the supported part thereof, extending between a first end (30) of the slides (4,5), nearest the roll and the roll.

4 Claims, 11 Drawing Sheets

U.S. PATENT DOCUMENTS

| | | | | | |
|---|---|---|---|---|---|
| 2,594,910 | A | * | 4/1952 | Germann | 296/98 |
| 3,163,204 | A | * | 12/1964 | Golde | 160/26 |
| 3,430,677 | A | * | 3/1969 | Pierce | 160/264 |
| 3,882,921 | A | * | 5/1975 | Sandall | 160/266 |
| 3,900,063 | A | * | 8/1975 | Roller | 160/310 |
| 4,220,189 | A | * | 9/1980 | Marquez | 160/23.1 |
| 4,408,650 | A | * | 10/1983 | Verch | 160/121.1 |
| 4,478,268 | A | * | 10/1984 | Palmer | 160/310 |
| 4,597,430 | A | * | 7/1986 | Marquez | 160/269 |
| 4,930,563 | A | * | 6/1990 | Finch et al. | 160/271 |
| 4,947,937 | A | * | 8/1990 | Searer et al. | 160/133 |
| 5,121,782 | A | * | 6/1992 | Renkhoff et al. | 160/22 |
| 5,542,463 | A | * | 8/1996 | Pinkalla et al. | 160/273.1 |
| 5,682,937 | A | * | 11/1997 | Decrane et al. | 160/133 |
| 5,794,678 | A | * | 8/1998 | Beringer et al. | 160/41 |
| 5,819,831 | A | | 10/1998 | Schanz | |
| 6,192,960 | B1 | * | 2/2001 | Simon | 160/84.06 |
| 6,672,691 | B1 | * | 1/2004 | Hoff | 312/297 |
| 6,715,531 | B2 | * | 4/2004 | Simon | 160/271 |
| 6,874,199 | B2 | * | 4/2005 | Simon et al. | 16/96 R |
| 7,017,644 | B1 | * | 3/2006 | Kraeutler | 160/271 |
| 7,516,770 | B2 | * | 4/2009 | Jerry | 160/267.1 |
| 2003/0034135 | A1 | * | 2/2003 | Simon | 160/271 |
| 2003/0136527 | A1 | * | 7/2003 | Weiss | 160/271 |
| 2006/0054284 | A1 | * | 3/2006 | Coenraets | 160/8 |

FOREIGN PATENT DOCUMENTS

| | | |
|---|---|---|
| EP | 0 780 542 | 6/1997 |
| FR | 344 292 | 10/1904 |

* cited by examiner

DEVICE WITH A SHUTTER WHICH MAY BE WOUND AROUND A DRUM

CROSS-REFERENCE TO RELATED APPLICATION

This application is a National Stage filing of PCT International Application Serial No. PCT/EP2008/051344, filed Feb. 4, 2008, which claims the benefit of European Application Serial No. EP 07101917.8, filed Feb. 7, 2007, the disclosures each of which are expressly incorporated herein by reference.

FIELD OF THE INVENTION

The present invention relates to a flexible shutter device intended to close a window or door opening or any type of opening, comprising driving means for moving the flexible shutter between an open position and a closed position; the driving means comprise a drum that can rotate about its axis, around which the flexible shutter is wound in its open position forming a roll consisting of successive turns attached to one another and from which the flexible shutter can be unwound and pushed towards its closed position. The device also comprises slideways mounted on a fixed support for guiding along the opening the part of the lateral edge of the shutter that is not wound, the flexible shutter comprising substantially non-compressible lateral edges projecting with respect to the plane of the lateral edge of the shutter and substantially continuous, moving in the slideways. The device according to the invention can for example be used in buildings or lorries or as a swimming pool or boat cover.

PRIOR ART

The devices intended for closing an opening comprising a drum around which a flexible shutter is wound in its open position are known. In such devices, the shutter is unwound by turning the drum about its axis, so that the shutter descends, closing the opening while the lateral edges of the latter are guided in two guide tracks or slideways extending parallel to each other. Through the rotation of the drum, a thrust force is exerted on the lateral edges of the shutter by means of the turns, which are attached to one another, in their longitudinal direction, thus pushing the lateral edges of the shutter to be moved in the slideways.

These devices have several drawbacks. Since the diameter of the roll formed around the drum varies according to the position of the shutter, a free space forms between the top ends of the closest slideways to the drum and the roll. Thus, part of the lateral edges of the shutter is not held by the slideways. Given the flexible character of the shutter, this non-held part of the shutter, easily deformable and foldable, may quickly become uncontrollable.

During the closure of the shutter, the progression of the lateral edges of the shutter in the slideways may be slowed down (friction due to the wind pressure which may be as much as 160 km/h). This friction opposes the thrust force exerted on the lateral edges of the shutter by the rotation of the drum. In this case, if the drum continues to be rotated, the shutter continues to unwind. In the free space between the roll and the top edge of the slideways, the lateral edges are no longer held and there is a risk, when there is a thrust on them, that they may form a fold and buckle. The formation of such a fold then prevents any sliding of the shutter in the slideways. It is necessary to stop the motor and once again wind up the shutter in order to absorb the fold that has formed. In addition, such a fold may damage the lateral edges of the shutter.

SUMMARY OF THE INVENTION

One aim of the invention is to remedy these drawbacks by presenting a shutter device that is closed in a controlled manner while guaranteeing that the lateral edges of the shutter do not buckle, that is to say do not form a fold between the roll and the top end of the slideways during unwinding thereof.

To this end, the device according to the invention is characterised in that it comprises confinement elements for preventing the buckling of the lateral edges 2, 3 in their part that is not held.

According to a first embodiment the confinement elements comprise a pressure element for exerting a thrust force on the lateral edges of the shutter at the non-held part of the shutter extending between a first end of the slideways and the roll, so as to obtain a radial thrust force resultant that continuously applies the lateral edges of the flexible shutter, in their non-held part, on the pressure element.

Thus, during unwinding, an excess of shutter forms between the top end of the slideways (the closest to the drum) and the roll. The pressure element ensures that the non-held part of the lateral edges of the shutter remains in abutment; in this way the formation of a fold between the roll formed on the drum and the end of the closest slideways to the drum is prevented.

According to another particular embodiment of the invention, the confinement means comprise a rod extending in line with the front arms of the slideways.

Preferably, the invention is as described in the dependent claims.

BRIEF DESCRIPTION OF THE FIGURES

These aspects as well as other aspects of the invention will be clarified in the detailed description of particular embodiments of the invention, reference being made to the drawings in the figures, in which.

The figures are not drawn to scale. Generally, similar elements are denoted by similar references in the figures.

DETAILED DESCRIPTION OF PARTICULAR EMBODIMENTS

It will be obvious to a person skilled in the art that the present invention is not limited to what was disclosed and described in particular above. The invention lies in the presentation of all novel features and each combination of these features. The numerical references in the claims do not limit the scope of their protection. The use of the verbs "comprise, have or include" and their conjugate forms does not exclude the presence of elements other than those enumerated in the claims. The use of the article "a/an" in front of an element does not exclude the presence of a plurality of such elements.

In general terms, the present invention relates to a flexible shutter device cooperating with driving means, such as a drum, the spindle of which is connected to the shaft of an electric motor. The flexible shutter moves between a closed position and an open position and is intended in particular for closing an opening in a door or passage, such as a corridor.

The term "flexible shutter" should be understood, in the context of the present invention, to mean any flexible flat element such as a canvas, articulated slats, metal sheet, etc., which is provided at its lateral ends with substantially non-compressible edges. It is also a case of a shutter that can be wound around a drum, the axis of which is perpendicular to the direction of movement of the shutter when the latter is opened.

It should however be noted that a pronounced preference is given to flexible shutters formed for example by a canvas. The accompanying figures consequently relate more particularly to such a canvas.

Figures 1, 2:
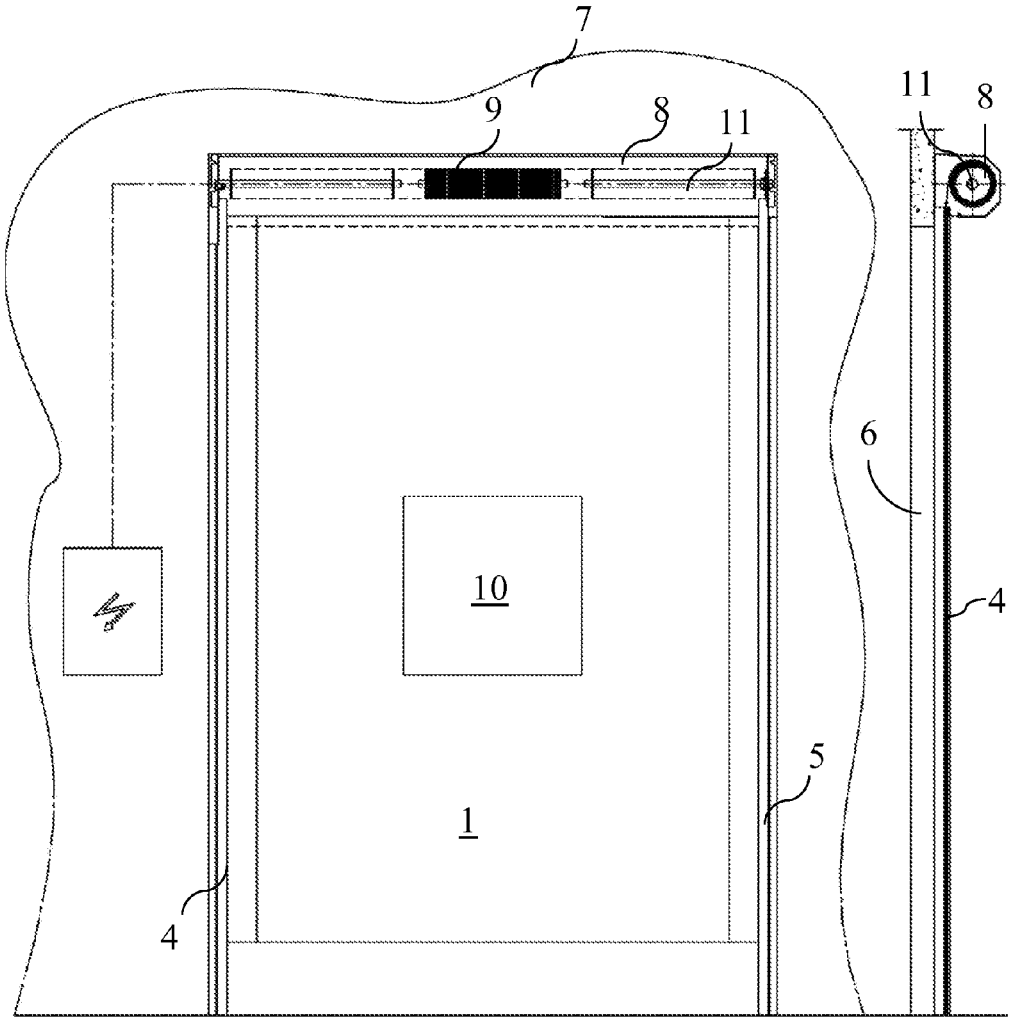
FIG. 1 shows a schematic front view of a flexible shutter device in the closed position.
FIG. 2 shows a side view of the flexible shutter device of FIG. 1.

In FIGS. 1 and 2, the shutter device is shown schematically in the closed position. This device comprises a flexible shutter 1 with lateral edges 2 and 3 projecting with respect to the plane of the shutter 1. The lateral edges 2 and 3 are advantageously formed by a continuous bead 46 (illustrated in detail in FIGS. 13 and 14) or by a succession of small teeth moving in vertical slideways 4 and 5. The slideways 4 and 5 are provided on each side of an opening 6 present in a wall 7.

Above the opening 6 there is provided a drum 8 on which the flexible shutter 1 can be wound. Inside the drum 8 there is arranged an electric motor 9 that drives the drum 8 about its spindle 11. This makes it possible to wind the shutter 1 on the drum 8 in order to bring it into the open position or to unwind the shutter 1 towards its closed position. During the movement of the shutter 1 towards the closed position, the lateral edges 2 and 3 thereof are guided by the slideways 4 and 5.

In the middle of the shutter 1, a transparent window 10 can be provided.

When the shutter 1 is opened, it is wound around the drum 8, forming a roll consisting of turns formed by successive superimposed layers of the shutter 1.

When the shutter 1 is wound around the drum 8, the successive turns of the shutter 1 are attached to one another. If the lateral edges 3, 4 of the shutter are provided with small teeth, these prevent the successive layers of the shutter 1 sliding with respect to one another.

Figure 3:
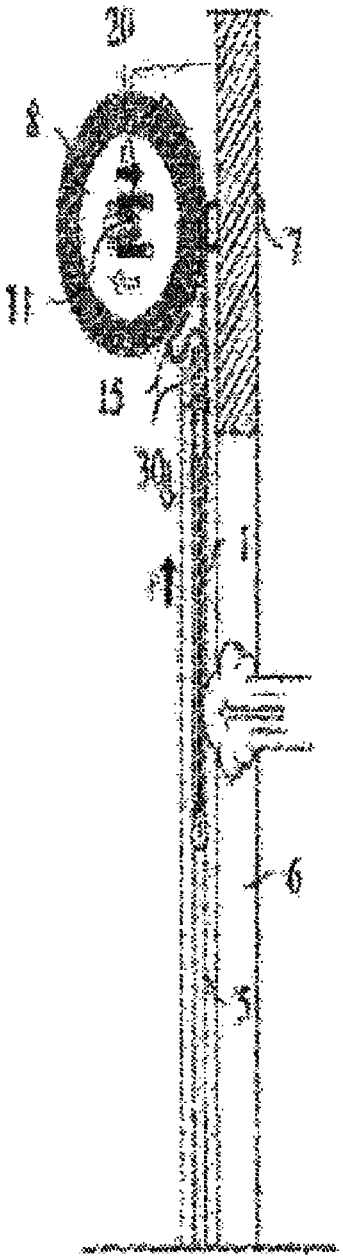
Fig. 3 PRIOR ART
FIG. 3 shows a side view of a shutter device according to the prior art when the flexible shutter is unwound.
Figure 4:
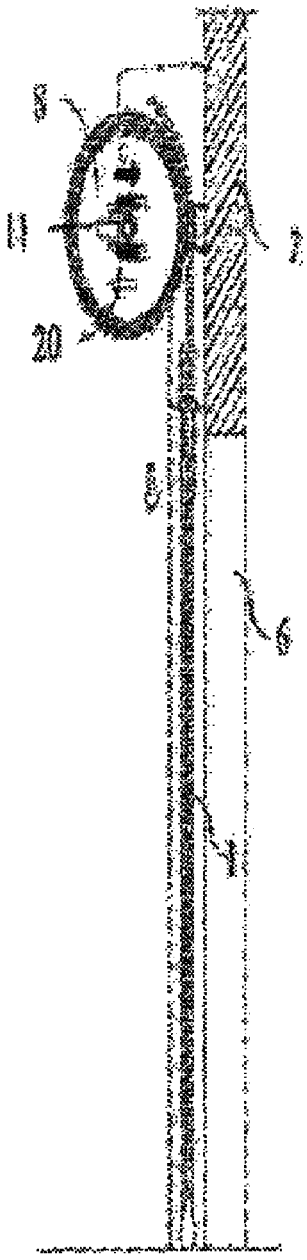
Fig. 4 PRIOR ART
FIG. 4 shows a lateral section of the flexible shutter device of FIG. 3 in the closed position.
Figure 5:
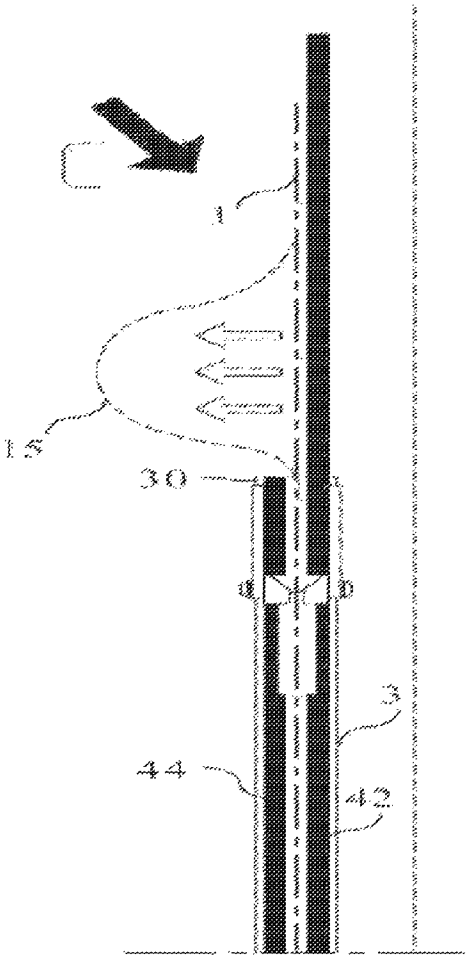
Fig. 5 PRIOR ART
FIG. 5 shows a schematic lateral section of a slideway in the device of FIG. 3 (prior art).

FIGS. 3, 4 and 5 show a shutter device according to the prior art.

The shutter 1 is unwound by rotating the drum 8 about its axis, so that the shutter 1 descends, closing the opening 6, while the lateral edges 2, 3 of the latter are guided in the two straight slideways 4, 5 extending parallel to each other. Through the rotation of the drum 8, a thrust force is exerted on the lateral edges 2, 3 of the shutter 1 in their longitudinal direction.

Each of the slideways 4, 5 has a U-shaped cross-section, the central part 40 of which is up against the structure of the opening 6, the opening of the U of a slideway 4 being directed towards the opening of the other slideway 5.

Figure 11:
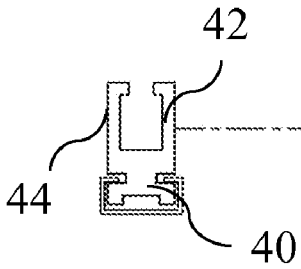
FIG. 11 shows a section along the line XI-XI of FIG. 9.
Figure 9:
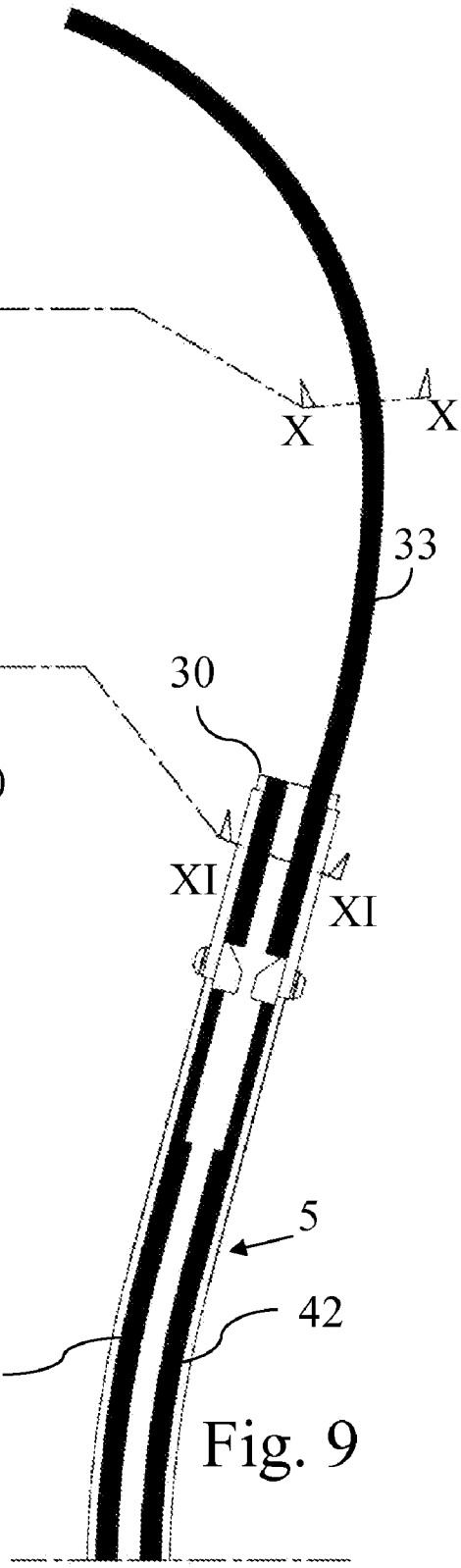
FIG. 9 shows a schematic lateral section of the top part of a slideway according to the invention.
Figures 12, 13, 14:
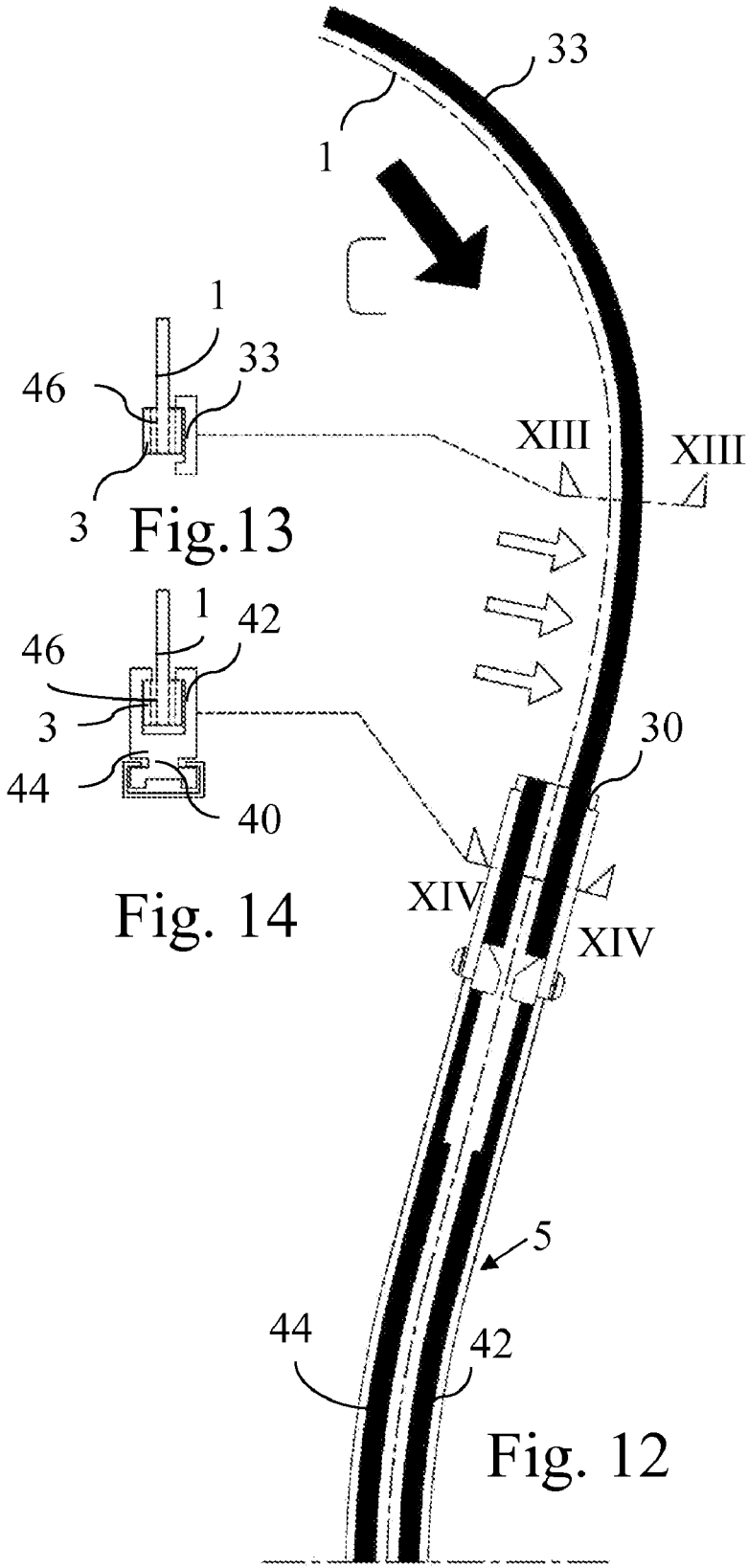
FIG. 12 shows a lateral schematic section of the top part of a slideway of a device according to the invention, in which the lateral edges of a flexible shutter slide.
FIG. 13 shows a section along the line XIII-XIII of FIG. 12.
FIG. 14 shows a section along the line XIV-XIV of FIG. 12.
Figure 16:
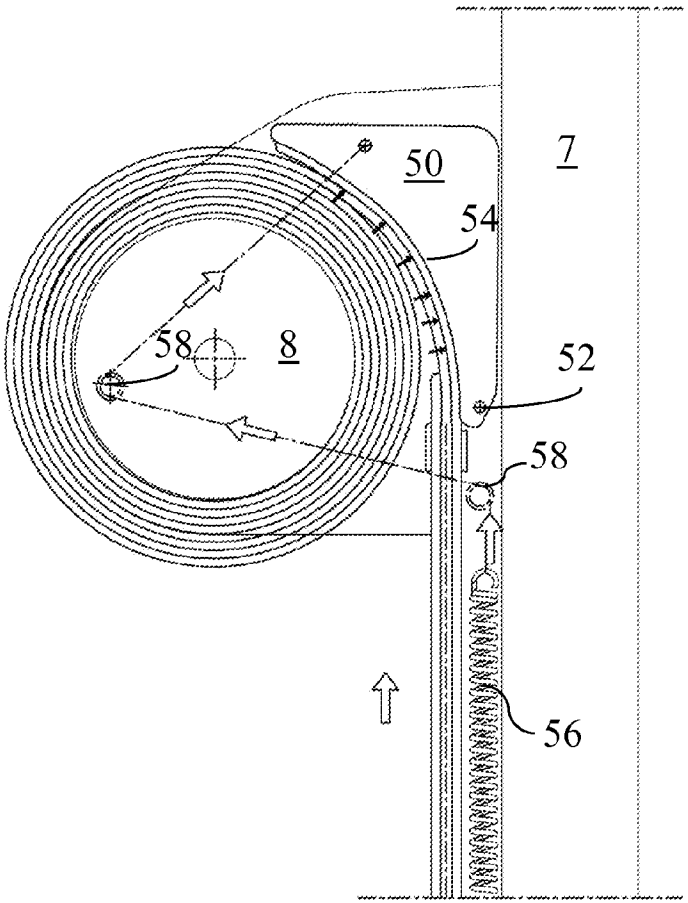
FIG. 16 shows a view similar to that of FIG. 15, the device being in the open position.
Figure 15:
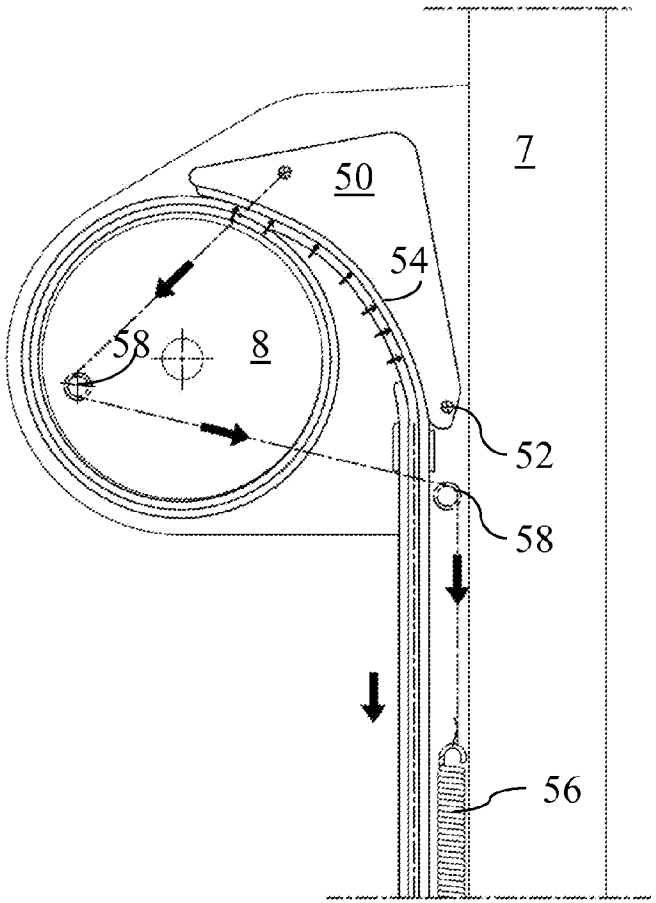
FIG. 15 shows a lateral view of the top part of a device according to another embodiment of the invention, in the closed position.
Figure 18:
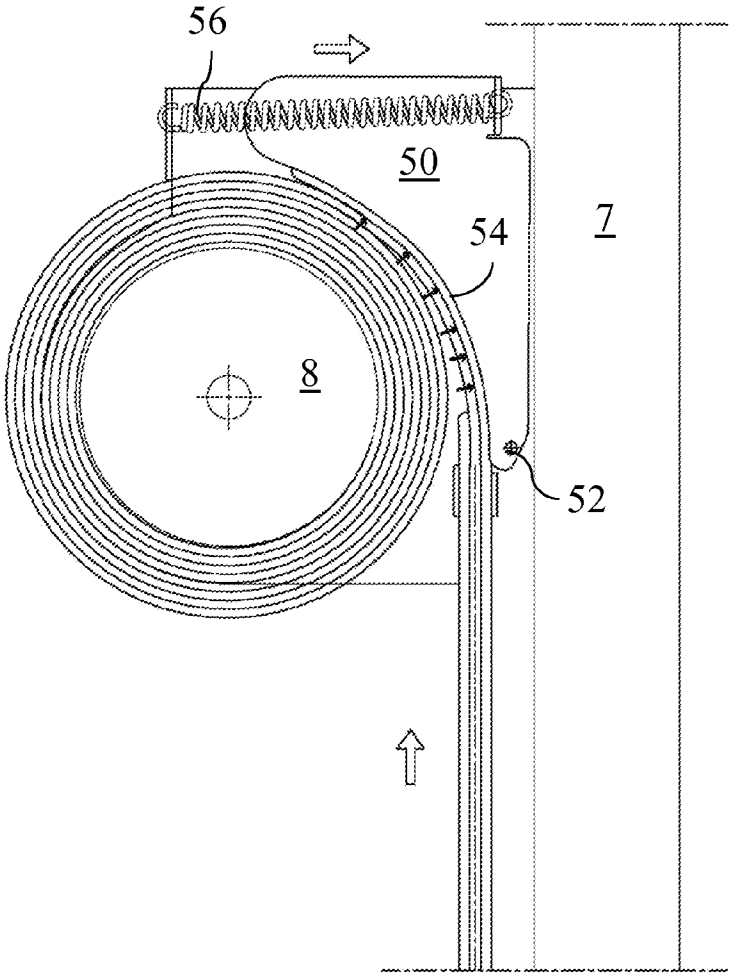
FIGS. 17 to 20 are views similar to those of FIGS. 15 and 16, of two variant embodiments.
Figure 17:
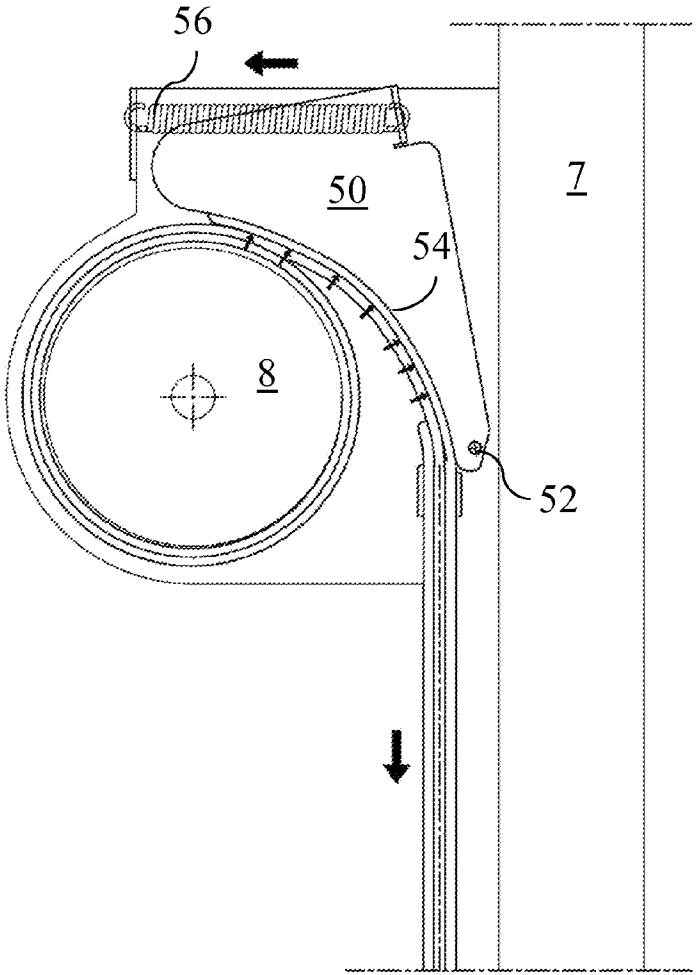
Figure 19:
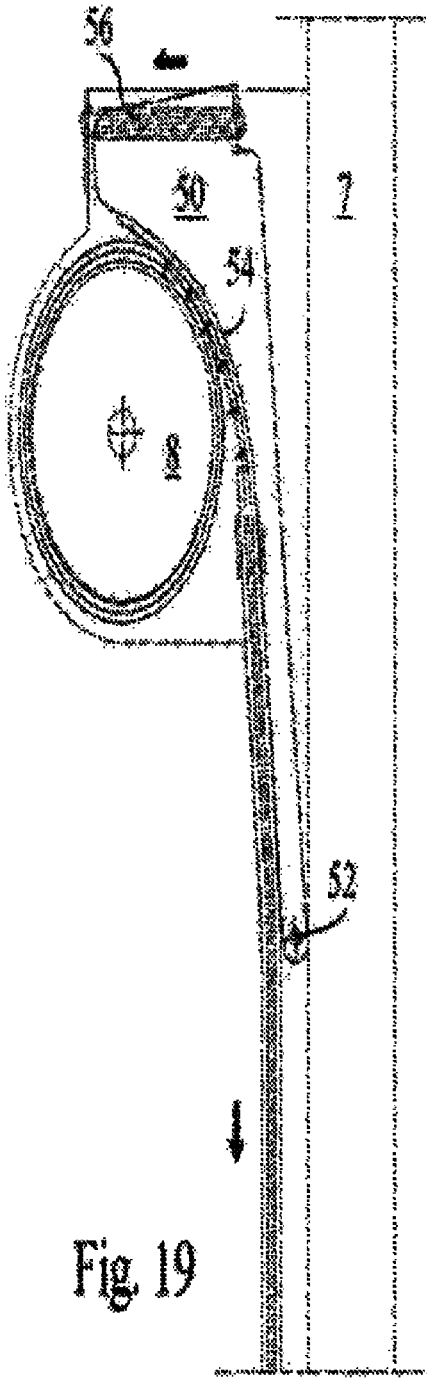
Figure 20:
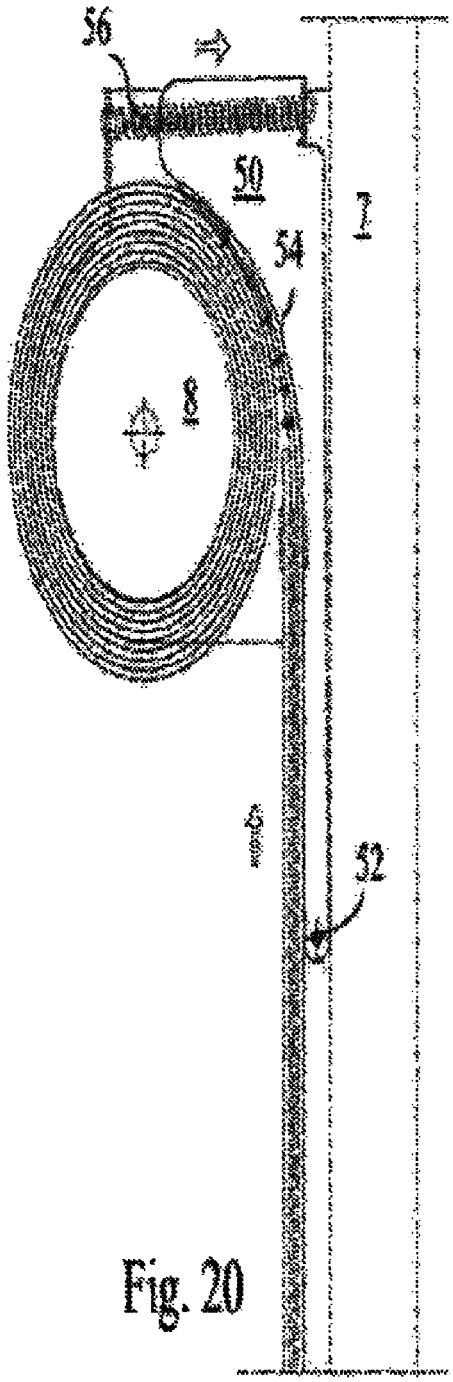

Each U-shaped slideway 4, 5 comprises an arm 42 that extends on the rear side, towards the wall 7, and another arm 44 that extends on the front side, towards the drum 8 (FIGS. 11 and 14).

Given that the diameter of the roll formed around the drum 8 varies according to the position of the shutter 1, a space exists between the roll and the closest top ends 30 of the slideways 4, 5 to the drum 8, in which the shutter 1 is neither held by the lateral edges 2, 3 in the slideways 4, 5, nor wound around the drum 8. Because of the flexible character of the shutter 1, this non-held part of the deformable and foldable shutter 1 may quickly become uncontrollable.

The drum 8 is kept in abutment against the structure of the wall 7 by means of of springs 20 directed along a substantially horizontal axis.

FIGS. 3 and 5 present the case where, when the opening 6 is closed, the descent of the shutter 1 along the slideways 4, 5 is blocked by an obstacle or by the friction due to the force of the wind. The drum 8 is still driven in rotation and the shutter 1 continues to unwind, creating an excess of shutter 1 between the roll and the top end 30 of the slideways 4, 5. Part of the excess of the shutter 1 remains wound on the drum 8, in particular because of the presence of attachment teeth for holding the turns on one another; the rest of the excess forms a fold 15 in the part of the shutter 1 that is not held, that is to say in the space between the roll 8 and the top end 30 of the slideways 4, 5. If the drum 8 continues to turn, the loop of the fold 15 increases. The shutter 1 folds in its non-held part directly at the exit from the slideways 4, 5; this fold prevents the shutter from re-entering the slideways 4, 5. It is necessary to stop the motor 8 and once again wind the shutter 1 in order to absorb the fold 15 that is formed.

FIGS. 6 to 12 show a flexible shutter device according to a first embodiment of the invention.

In this first embodiment of the invention, the slideways 4, 5 are substantially straight and vertical over the major part of their height. The top part of the slideways 4, 5 is inclined towards the wall 7 with respect to the plane formed by these same slideways 4, 5.

In their part just below their top part, the slideways can have a convex boss 34 to enable them to return to the vertical plane.

In addition, the rear arm 42 of the slideways 4, 5 is extended upwards by a curved flexible guide 33. The set of curves 33 and 34 forms a flattened "S".

FIGS. 9 to 14 show this guide 33 in more detail. In the example illustrated, the guide 33 has a profile in the shape of a flattened U. This shape is adapted to the particular shape of the lateral edge of the shutter, which, in the example illustrated, has a projecting bead 46 (illustrated in FIGS. 13 and 14).

The guide 33 constitutes a pressure element that exerts a thrust force (illustrated by arrows in FIG. 12) at the point where, when the shutter 1 is wound, the surface of the part of the shutter 1 that is not yet wound comes into contact with the part of the shutter 1 that already forms turns around the drum 8. The guide 33 keeps the turns adjacent to one another. In the case of a shutter comprising attachment teeth, the guide 33 exerts a pressure on these attachment teeth in order to fix the successive turns of the shutter to one another when the shutter is wound around the drum 8.

Figure 8:
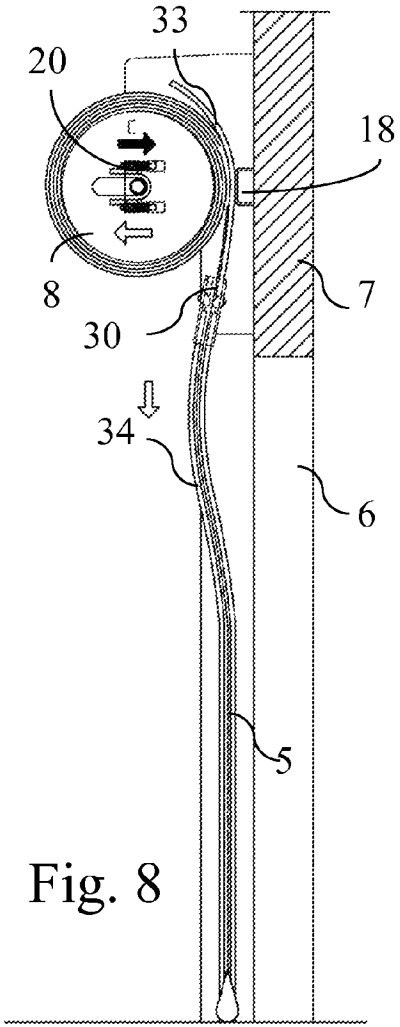
FIG. 8 shows a lateral section of the device of FIG. 6 in the closed position.
Figure 6:
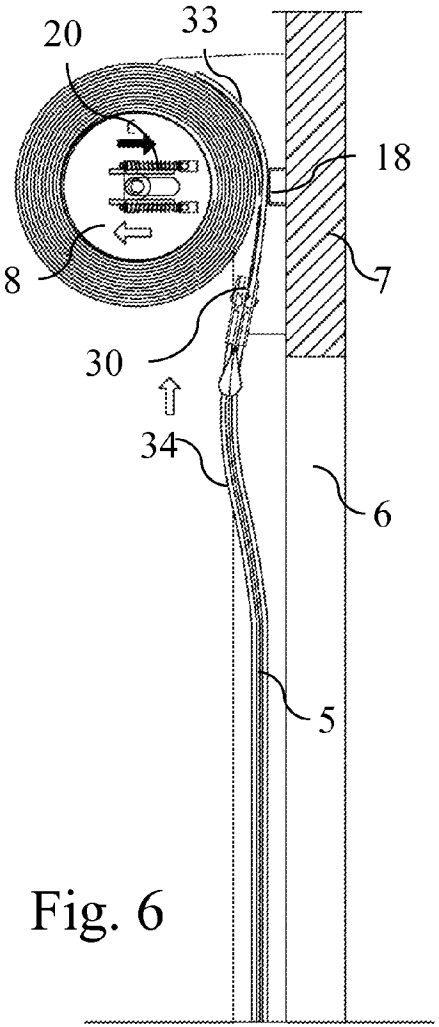
FIG. 6 shows a lateral section of a flexible shutter device, in the open position, according to one embodiment of the invention.
Figure 7:
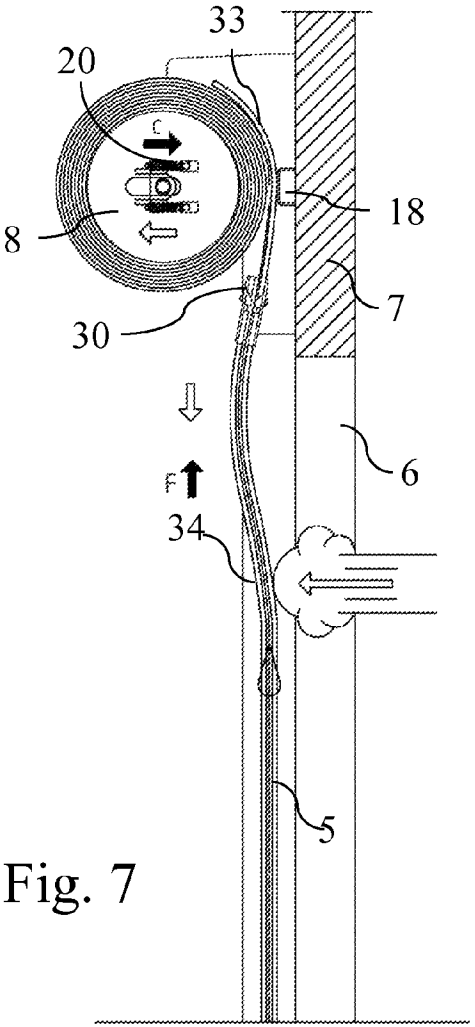
FIG. 7 shows a lateral section of the device of FIG. 6 when the flexible shutter is unwound.
Figure 10:
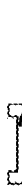
FIG. 10 shows a section along the line X-X of FIG. 9.

The guide 33 is kept in abutment against the wall 7 by means of an abutment element 18. The abutment element 18 is provided at the point where, when the shutter 1 is wound, the surface of the part of the shutter 1 that is not yet wound comes into contact with the part of the shutter 1 that already forms turns around the drum 8 (FIGS. 6 to 8).

According to the invention, the pressure element 33 exerts a thrust force on the lateral edges 2, 3 of the shutter 1 at the non-held part of the shutter 1 extending between the top end 30 of the slideways 4, 5 and the roll, so as to obtain a radial thrust force resultant that continuously applies the lateral edges of the shutter, in the non-held part, on the pressure element 33.

The end 30 thus guides the shutter 1 at the exit from the slideways 4, 5 so as to form a curvature 33 in the non-held part of the shutter 1. The curvature 33 of the shutter 1 in its non-held part is concave with respect to the drum 8 (FIG. 12).

The slideways have, according to the mode illustrated, a curvature 34 opposite to the curvature 33 so as to recover the straight plane of the slideways 4, 5 in their bottom part.

By virtue of this continuity in the curvature 33, any excess of shutter 1 that would form in the non-held part in the event of friction in the slideways 4, 5 when the shutter 1 is unwound is "absorbed" by the curvature 33 of the shutter 1 in its non-held part. This is because, given that it is very difficult to overcome a curvature in a flexible shutter, buckling and formation of a fold (as in the case of FIG. 3) are prevented in the non-held part of the edges of the shutter. This is shown in FIG. 12.

Preferably, in the open position, the top end 30 of the slideways 4, 5 comes close to the last turn of the shutter wound on the drum 8.

In the closed position, a space may appear between the top end 30 of the slideways and the last turn wound. In this space the lateral edges 2, 3 of the shutter are not held.

FIGS. 15 to 23 show four variant embodiments. In these variant embodiments, the drum 8 is no longer movable along a substantially horizontal axis but is held fixedly.

In the variant embodiments illustrated in FIGS. 15 to 20, the device comprises a movable abutment structure 50 that keeps the guide 33 in permanent contact with the last turn wound on the drum 8 whatever the open or closed state of the device, that is to say whatever the volume of the roll. In these embodiments, the guide 33 contributes mainly a sliding effect that limits the friction. However, it would also be possible, without departing from the scope of the invention, to dispense with this guide and produce an abutment structure 50 that is directly in contact with the last turn of the roll.

The movable abutment structure 50 can take various forms. In FIGS. 15 to 20, it is a case of a substantially triangular element, pivoting on the pivot spindle 52 and the face 54 of which turned towards the drum has a concave curvature with respect to the drum 8.

Various return systems can be imagined, so as to make the abutment system movable and to keep it in permanent abutment so as to prevent buckling and detachment of the turns with respect to one another. In particular, systems comprising springs 56 and possibly return pulleys 58 as illustrated in FIGS. 15 to 20 can serve as a return system.

Figure 22:
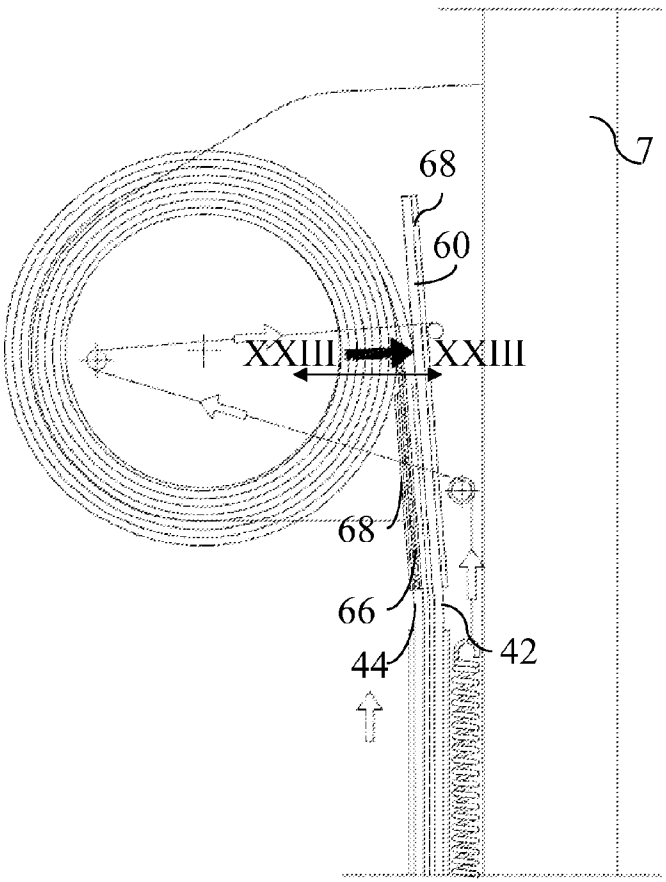
FIGS. 21 and 22 are views similar to those of FIGS. 15 and 16 of another embodiment.
Figure 21:
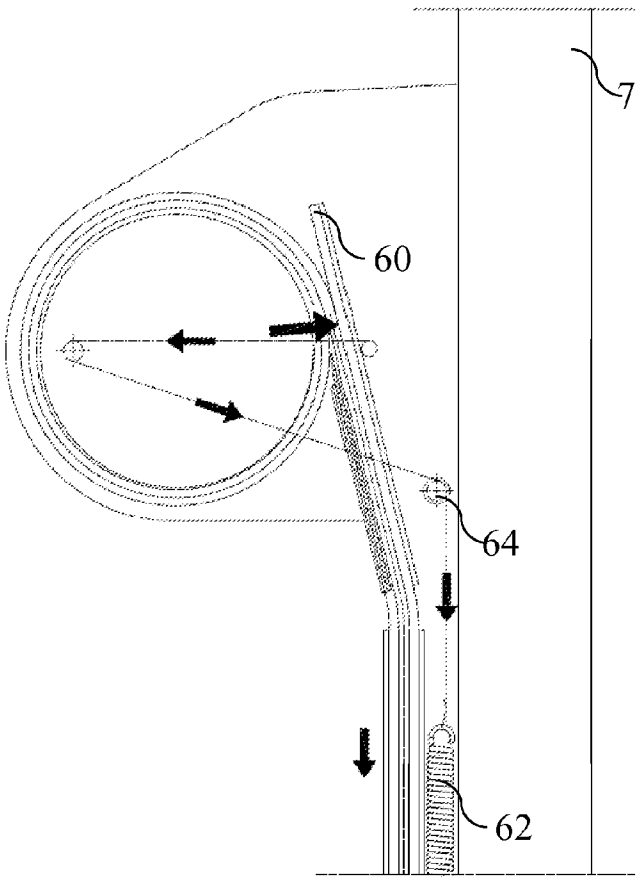
Figure 23:
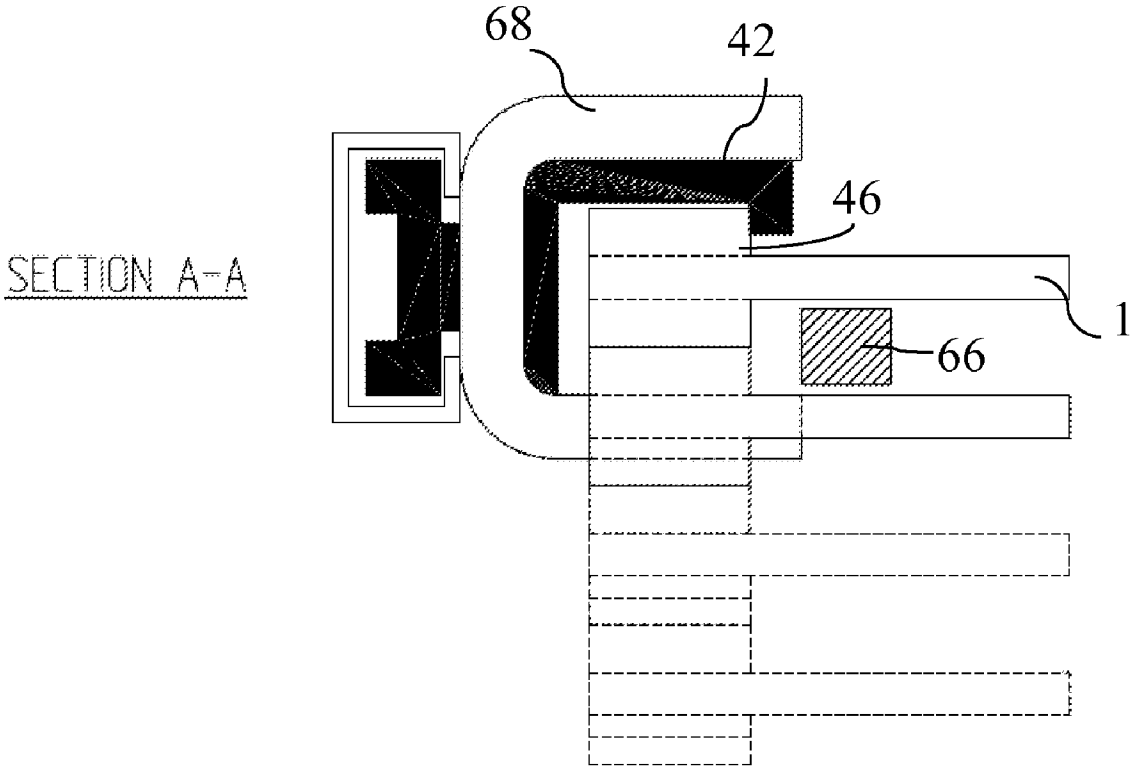
FIG. 23 shows a section along the line XXIII-XXIII of FIG. 22.

In FIGS. 21 to 23, the confinement element consists of a substantially straight rod 66 that extends upwards in line with the front arm 44 of each slideway 4, 5. This rod 66 preferably extends between the last turn wound on the roll and the part of the shutter 1 not yet wound, close to the lateral edge 2, 3, just in front of the rim 46 (FIG. 23).

In the example illustrated, the rear arm of each slideway 4, 5 is also extended upwards by a substantially straight guide 60. A reinforcing U 68 can be provided around the guide 60 and the rod 66. A return system comprising springs 62 and return pulleys 64 keeps the guide 60 in abutment against the roll.

The rod 66 can extend up to a height corresponding to the contact point between the roll and the guide 60.

In this last embodiment, there is no longer any radial thrust force; the return system must therefore be less powerful than in the previous embodiments. The friction between the rod 60 and the turns is therefore advantageously reduced.

When the shutter is wound and unwound without force, the rod 66 does not come into contact with the shutter, a slight space is maintained between the rod and the shutter on each side of the rod. If an obstacle interrupts the closure of the shutter or a particular pressure increases the friction, the shutter, close to its lateral edge, then comes against the rod. The latter then prevents the shutter from buckling.

The present invention has been described in terms of specific embodiments that are an illustration of the invention and that must not be considered to be limitative.

In particular, the device has been described in a position where the shutter moves in a vertical plane and in a direction from top to bottom (during closing).

Naturally, the position of the shutter and drum is not limitative. The same device can be used in other positions and in particular the shutter may be vertical but open in a lateral direction. Likewise, the device according to the invention can be used in a horizontal position, for example for covering boats or swimming pools.

The top end of the slideways must then be understood as the closest end to the drum; however, for reasons of clarity of the disclosure with respect to the figures, it is referred to as the top end in the present description.

In addition, the device according to the invention has the advantage of closing a door or window opening or any type of opening without any ballasting of the flexible shutter.

The invention claimed is:

1. Flexible shutter device intended for closing a window or door opening or any type of opening, comprising:

a shutter comprising lateral edges, driving means for moving the shutter between an open position and a closed position, the driving means comprising a motor-driven drum and a spindle, the drum rotatable about its spindle, around which the shutter is wound in its open position forming a roll consisting of turns formed by successive layers attached to one another and from which the shutter can be unwound and pushed by rotation of the drum by the motor towards its closed position, slideways mounted on a fixed support for guidance, along the opening, of the lateral edges of the non-wound part of the shutter, the lateral edges being substantially non-compressible, the slideways having a U-shaped cross-section including a rear arm, a front arm and a central part, the central part of which is up against the structure of the opening, the two arms of the U-shaped cross-section of the slideways each being disposed in a plane parallel to the plane of the shutter, characterized in that the device comprises confinement elements comprising an extension of the rear arms of each slideway towards the roll, which consists of a pressure element having a concave curvature with respect to the drum, so as to obtain a radial thrust force resultant that continuously applies the lateral edges of the shutter on the pressure element between a first end of the slideways being closest to the roll, and the roll, and preventing buckling of the lateral edges of the shutter there between, and in that the shutter lacks any ballasting.

2. Device according to claim 1, characterized in that the lateral edges of the shutter have a bead projecting with respect to the plane of the shutter extending between the lateral edges.

3. Device according to claim 1, characterized in that the slideways are substantially straight and have, in their top part just below the pressure element, an inclination with respect to the plane of the slideways moving the top end of the slideways away from the drum.

4. Device according to claim 1, characterized in that the pressure element comprises a flexible guide.

* * * * *